US006255769B1

(12) United States Patent
Cathey et al.

(10) Patent No.: US 6,255,769 B1
(45) Date of Patent: Jul. 3, 2001

(54) FIELD EMISSION DISPLAYS WITH RAISED CONDUCTIVE FEATURES AT BONDING LOCATIONS AND METHODS OF FORMING THE RAISED CONDUCTIVE FEATURES

(75) Inventors: David A. Cathey, Boise; Charles M. Watkins, Eagle, both of ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/608,531

(22) Filed: Jun. 30, 2000

Related U.S. Application Data

(63) Continuation of application No. 08/999,014, filed on Dec. 29, 1997, now abandoned.

(51) Int. Cl.[7] ..... H01J 9/36

(52) U.S. Cl. ..... 313/422; 445/24; 228/180.22; 438/613

(58) Field of Search ..... 445/24; 313/422; 228/180.22; 438/118, 613

(56) References Cited

U.S. PATENT DOCUMENTS

| | | | | |
|---|---|---|---|---|
| 4,376,505 | | 3/1983 | Wojcik | 228/215 |
| 4,940,916 | | 7/1990 | Borel et al. | 313/306 |
| 5,116,228 | * | 5/1992 | Kabeshita et al. | 228/180.22 |
| 5,186,670 | | 2/1993 | Doan et al. | 445/24 |
| 5,194,344 | | 3/1993 | Cathey, Jr. et al. | 430/5 |
| 5,194,346 | | 3/1993 | Rolfson et al. | 430/5 |
| 5,205,770 | | 4/1993 | Lowrey et al. | 445/24 |
| 5,210,472 | | 5/1993 | Casper et al. | 315/349 |
| 5,229,331 | | 7/1993 | Doan et al. | 437/228 |
| 5,259,799 | | 11/1993 | Doan et al. | 445/24 |
| 5,372,973 | | 12/1994 | Doan et al. | 437/228 |
| 5,534,127 | * | 7/1996 | Sakai | 228/180.22 |
| 5,563,470 | | 10/1996 | Li | 313/496 |
| 5,653,017 | | 8/1997 | Cathey et al. | 29/830 |
| 5,653,619 | | 8/1997 | Cloud et al. | 445/24 |
| 5,745,986 | | 5/1998 | Variot et al. | 29/840 |
| 5,766,053 | | 6/1998 | Cathey et al. | 445/25 |
| 5,827,102 | | 10/1998 | Watkins et al. | 445/25 |

OTHER PUBLICATIONS

"Liquid Crystal Display Products," Product Brochure, Standish LCD, Division of Standish Industries, Inc. pp. 5–6.
Kondoh et al., "A Subminiature CCD Module Using a New Assembly Technique," IEICE Transactions, vol. #74, No. 8, Aug. 1991.

* cited by examiner

*Primary Examiner*—Kenneth J. Ramsey
(74) *Attorney, Agent, or Firm*—Dorsey & Whitney LLP

(57) ABSTRACT

A field emission display with raised conductive features at bonding locations, and methods of forming the raised conductive features. In accordance with one embodiment of the invention, a plurality of applicators are arranged in a pattern corresponding to a pattern of bonding locations on either a baseplate or a faceplate of a field emission display. The bonding locations and respective applicators are aligned with each other, and then a predetermined quantity of a thick film conductive bonding material is deposited substantially simultaneously through each applicator onto each bonding location. The thick film conductive bonding material forms a conductive pad at each bonding location. The pads of thick film conductive bonding material are subsequently fired to form a raised feature at each bonding location.

27 Claims, 6 Drawing Sheets

FIELD EMISSION DISPLAYS WITH RAISED CONDUCTIVE FEATURES AT BONDING LOCATIONS AND METHODS OF FORMING THE RAISED CONDUCTIVE FEATURES

CROSS-REFERENCE TO RELATED APPLICATION

This application is a Continuation of U.S. patent application Ser. No. 08/999,014, filed Dec. 29, 1997, now abandoned.

TECHNICAL FIELD

The present invention relates to field emission displays, and, more particularly, to field emission displays with raised conductive features formed at selected bonding locations between the baseplates and the faceplates of the field emission displays.

BACKGROUND OF THE INVENTION

Field emission displays ("FEDs") are flat panel displays for use in computers, television sets, instrument displays, camcorder view finders and a variety of other applications. FEDs generally have a faceplate with a glass panel, a substantially transparent anode covering an inner surface of the glass panel, and a cathodoluminescent film covering the anode. FEDs also have a baseplate with an emitter substrate and an extraction grid. As described below, the faceplate and baseplate are generally spaced apart from one another so that the cathodoluminescent film is juxtaposed to the emitter substrate and the extraction grid.

FIG. 1 illustrates a portion of a conventional FED baseplate 20 with an emitter substrate 30 that carries a plurality of emitters 32. The emitter substrate 30 also carries a dielectric layer 40 with a plurality of cavities 42 around the emitters 32, and the dielectric layer 40 supports a conductive extraction grid 50 with a plurality of holes 52 over the emitters 32. The cavities 42 and the holes 52 expose the emitters 32 to the cathodoluminescent film on the faceplate (not shown).

FIG. 2 is a top schematic view of the baseplate 20 that illustrates one technique for extracting electrons from selected emitters. The emitters 32 may be grouped into discrete emitter sets 33 configured in rows (e.g., $R_1$–$R_3$) and columns (e.g, $C_1$–$C_2$). A number of high-speed row interconnects 55 on the extraction grid 50 commonly connect a plurality of emitter sets 33 along row address lines, and a number of high-speed column interconnects 37 on the emitter substrate 30 commonly connect emitter sets 33 along column address lines. As best shown in FIG. 1, the row interconnects 55 are formed on top of the extraction grid 50 and the column interconnects 37 are formed beneath the extraction grid 50. It will be appreciated that the row and column assignments illustrated in FIGS. 1 and 2 are for illustrative purposes only, and that other row/column assignments may be implemented in field emission displays.

To operate a specific emitter set 33, drive circuitry (not shown) generates row and columns signals along the coordinates of the specific emitter set 33 to create a voltage differential between the extraction grid and the specific emitter set. Referring to FIG. 2, for example, a row signal along row $R_2$ of the extraction grid 50 and a column signal along column $C_1$ of the emitter substrate 30 activates the emitter set 33 at the intersection of row $R_2$ and column $C_1$. The voltage differential between the extraction grid 50 and the selected emitter set 33 produces a localized electric field that extracts electrons from the emitters 32 in the selected emitter set. The anode on the faceplate then attracts the extracted electrons across a vacuum gap between the extraction grid and the cathodoluminescent layer. As the electrons strike the cathodoluminescent layer, light emits from the impact site and travels through the anode and the display screen. The emitted light from each area becomes all or part of a picture element.

Constructing FEDs raises several manufacturing issues that are best understood in light of the relationship between the baseplate and the faceplate. FIG. 3 is an exploded schematic cross-sectional view of a conventional FED 10 with the baseplate 20 and a faceplate 60. In addition to the components described above in FIGS. 1 and 2, the baseplate 20 also has a plurality of bond pads 36 in or on the emitter substrate 30 such that each bond pad 36 is coupled to an end of a column interconnect 37 to provide contact points for the drive circuitry of a particular column of emitter sets 33. The faceplate 60 has a transparent substrate 62, an optically transmissive anode 64 covering the transparent substrate 62, and a cathodoluminescent film 66 covering the anode 64. The faceplate 60 also has spacers 63*a* and 63*b* on opposite sides of the anode 64 and the cathodoluminescent film 66. A number of leads 80 (only one shown on each side) coupled to the drive circuitry (not shown) extend to the spacers 63*a* and 63*b*, and each lead 80 has a connector pad 82 and a raised feature 84 positioned on one of the spacers 63*a* or 63*b*. The raised features 84 are formed in a pattern corresponding to the pattern of bond pads 36 in the baseplate 20. The leads 80 and connector pads 82 are typically aluminum traces having a thickness of 12–20 $\mu$m, and the raised features 84 are typically 20–50 $\mu$m points formed by individually pinching the aluminum of the connector pads 82.

One particular manufacturing concern is that attaching the baseplate 20 to the faceplate 60 is a time-consuming and labor intensive process. For example, because the raised features 84 are formed individually by pinching the connector pads 82, it takes a significant amount of time to form all of the raised features 84. Moreover, because the bond pads 36 are typically quite small and spaced very close to one another, some of the raised features 84 may not align with a corresponding bond pad 36 when the baseplate 20 and the faceplate 60 are juxtaposed to one another. Such misalignment between the bond pads 36 and the raised features 84 may accordingly damage the baseplate 20 or severely impair the performance of the FED when the faceplate 60 is attached to the baseplate 20. Many FEDs 10, therefore, must be tested individually and either repaired or thrown-away. Thus, forming the raised features 84 is a problematic aspect of constructing FEDs.

SUMMARY OF THE INVENTION

The present invention is directed toward FEDs with raised features for connecting leads on a faceplate to terminals on a baseplate, and methods for forming the raised features. Some embodiments are particularly useful for forming raised features used in flip-chip bonding processes in which a plurality of bonding locations on the faceplate and the baseplate are coupled together. In accordance with an embodiment of the invention, a plurality of applicators are configured to correspond to a pattern of bonding locations on the baseplate or the faceplate. The bonding locations and applicators are aligned with each other such that each bonding location is positioned with respect to a corresponding applicator. A predetermined quantity of a thick film conductive bonding material is then deposited substantially simultaneously through each applicator to form a small pad of conductive material at each bonding location. The pads of thick film conductive bonding material are subsequently fired to form a raised feature at each bonding location.

In another embodiment for forming conductive raised features on a plate of a field emission display, a plurality of connector pads are formed at bonding locations on the plate. The connector pads may be traces composed of gold, copper or other suitably conductive and malleable materials. A die with a plurality of recesses configured in a pattern corresponding to the pattern of bonding locations is then positioned over the plate to align the recesses with the corresponding bonding locations. After the die is positioned over the plate, the die presses against the connector pads to drive a portion of each connector pad into a corresponding recess. The portions of the connector pads in the recesses forms a plurality of raised features on the plate such that a raised feature extends upwardly from each connector pad at a desired bonding location.

DETAILED DESCRIPTION OF THE INVENTION

The present invention is directed toward FEDs with a plurality of raised features or coupling elements at bonding locations on the faceplates and/or the baseplates of the FEDs. Many specific details of certain embodiments of the invention are set forth in the following description and in FIGS. 4–10 to provide a thorough understanding of such embodiments. One skilled in the art, however, will understand that the present invention may have additional embodiments and may be practiced without several of the details described in the following description.

Figure 1:
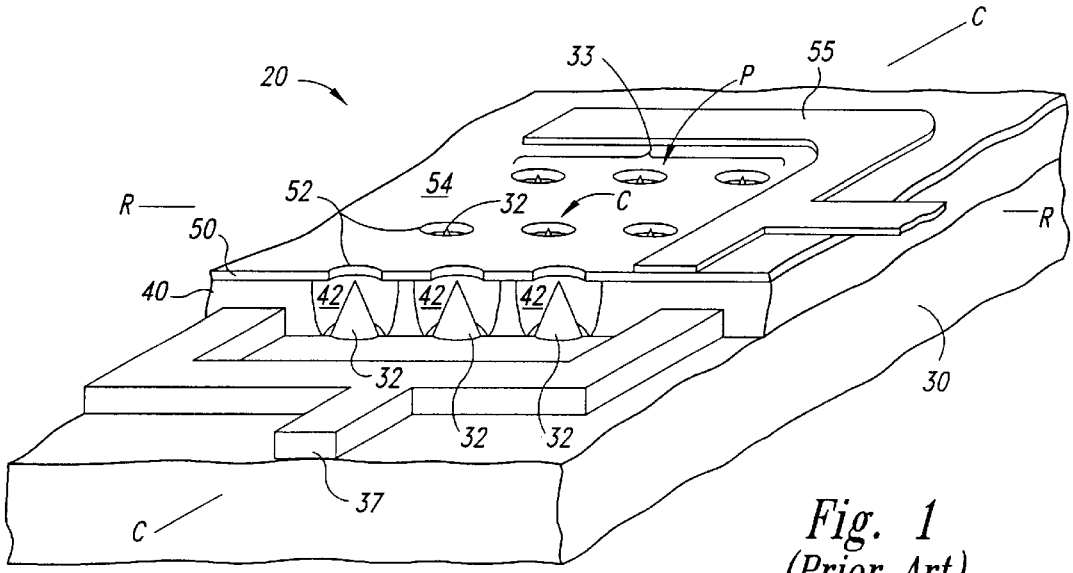
Fig. 1 (Prior Art)
FIG. 1 is a partial schematic isometric view of a baseplate for a field emission display in accordance with the prior art.
Figure 2:
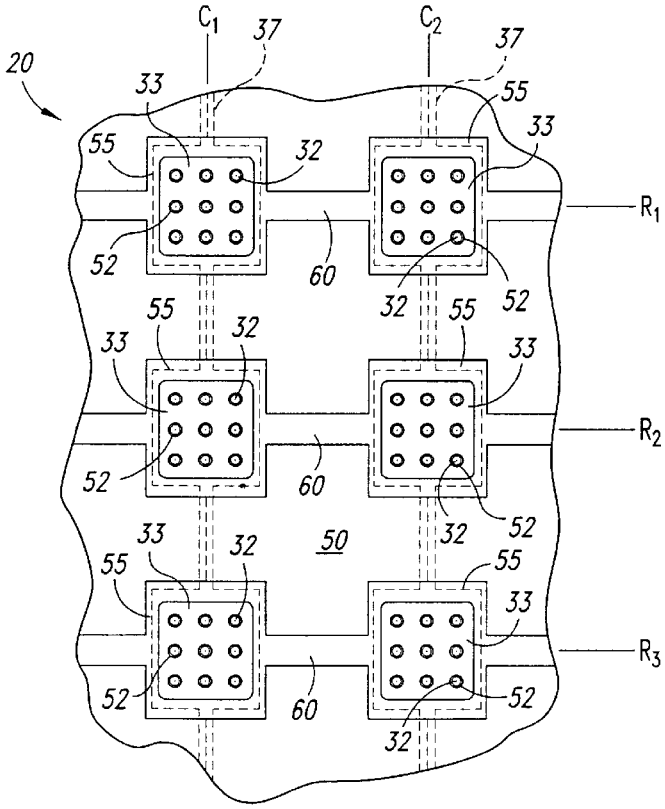
Fig. 2 (Prior Art)
FIG. 2 is a partial schematic top plan view of the baseplate of FIG. 1.
Figure 3:
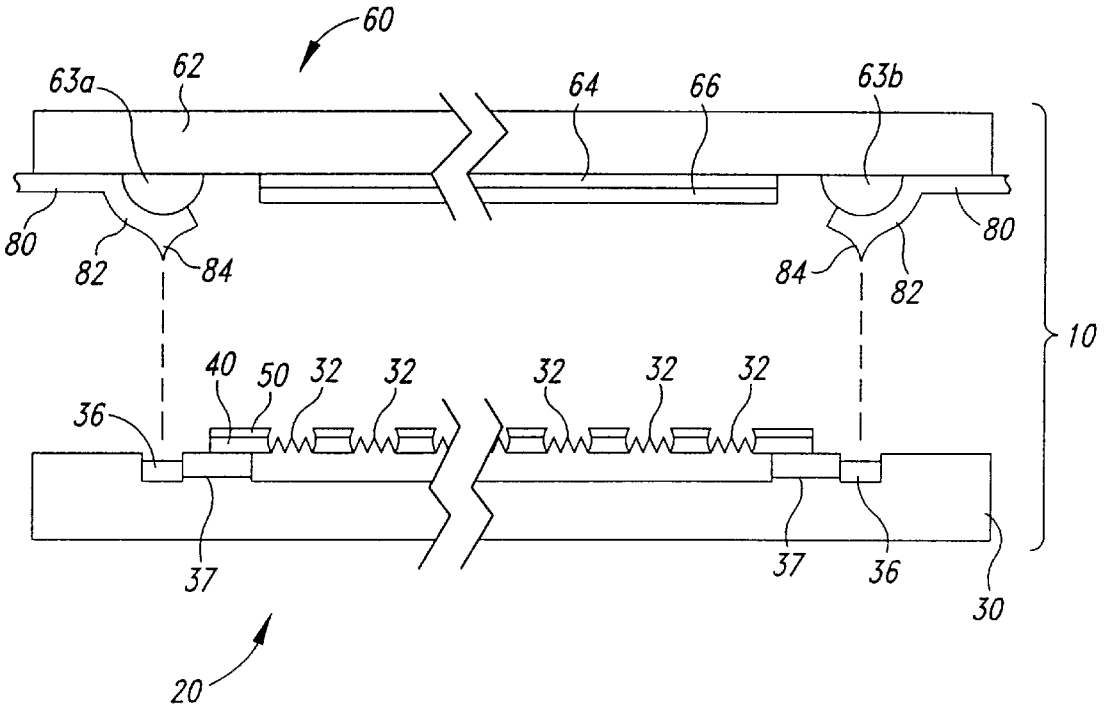
Fig. 3 (Prior Art)
FIG. 3 is an exploded schematic cross-sectional view of a portion of a field emission display in accordance with the prior art.
Figure 5:
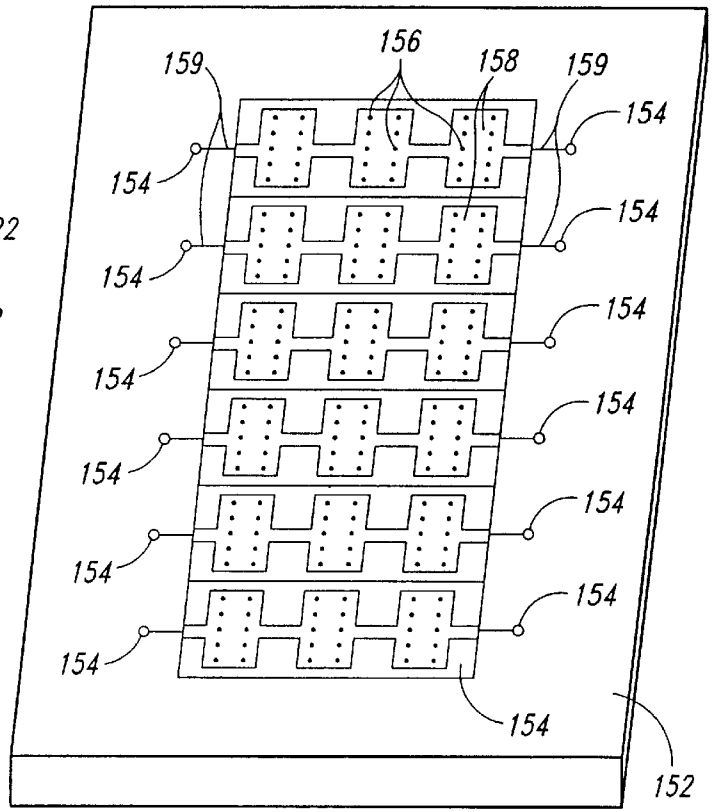
FIG. 5 is a schematic isometric view of a baseplate subassembly illustrating a stage of a method in accordance with an embodiment of the invention prior to forming raised features on the baseplate.
Figure 4:
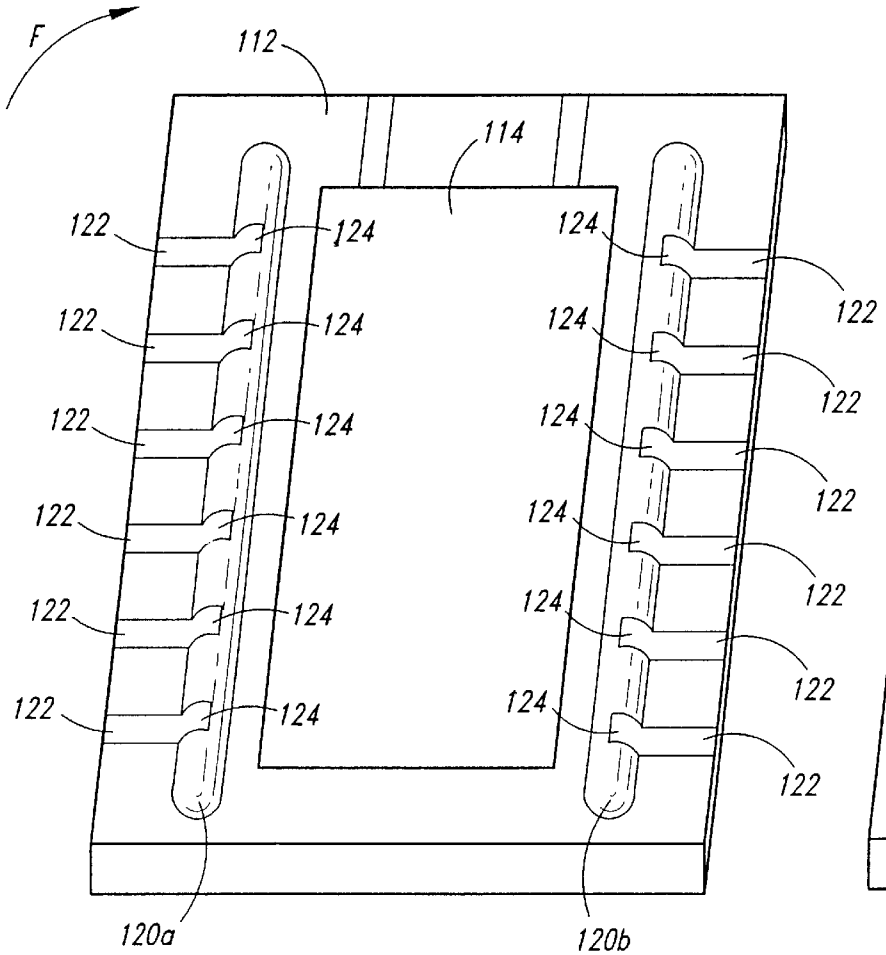
FIG. 4 is a schematic isometric view of a faceplate subassembly illustrating a stage of a method in accordance with an embodiment of the invention prior to forming raised features on the faceplate.

FIGS. 4 and 5 are schematic isometric views illustrating a faceplate 110 (FIG. 4) and a baseplate 150 (FIG. 5) upon which raised features are formed at bonding locations. Referring to FIG. 4, the faceplate 110 may have a transparent substrate 112 covered by a transparent anode (not shown) and a cathodoluminescent film 114 disposed on the anode. The faceplate 110 may also have spacers 120*a* and 120*b* positioned on opposing sides of the cathodoluminescent film 114. A number of leads 122 are preferably positioned at incremental distances over a portion of the spacers 120*a* and 120*b*, and each lead 122 may have a connector pad 124 toward the apex of the spacers 120*a* and 120*b*. Now referring to FIG. 5, the baseplate 150 may have a number of emitters 156 formed on a base substrate 152. The emitters 156 may be arranged in a number of emitter sets 158 across the surface of the base substrate 152, and a row of bond pads 154 may be positioned along the sides of the base substrate 152. The bond pads 154 may be configured so that a bond pad 154 is positioned at both ends of each row or column of emitter sets 158, and each bond pad 154 is coupled to its corresponding row or column of emitter sets 158 by an interconnect 159. The connector pads 124 on the faceplate 110 and bond pads 154 on the baseplate 150 are arranged in a defined pattern such that each connector pad 124 may be aligned with a corresponding bond pad 154 when the faceplate 110 is positioned (arrow F) over the baseplate 150. As described below, the connector pads 124 and the bond pads 154 define bonding locations or sites at which conductive raised features or coupling elements may be formed to couple the leads 122 on the faceplate 110 to corresponding rows or columns of emitter sets 158 on the baseplate 150.

Figure 6:
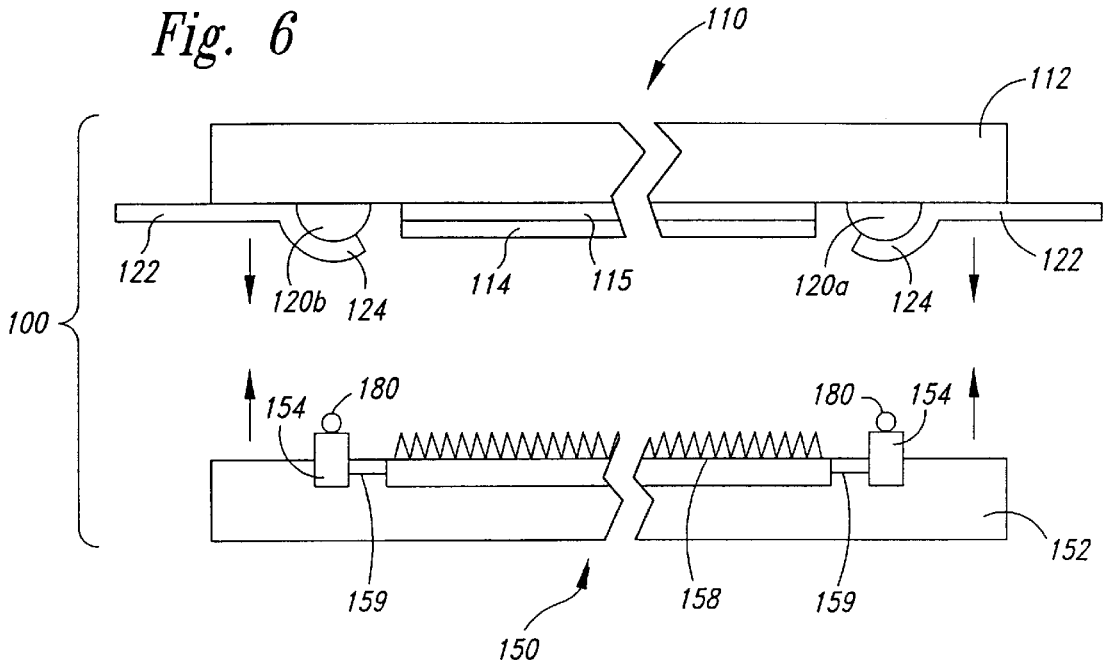
FIG. 6 is a schematic cross-sectional view of a portion of a faceplate positioned and aligned with a baseplate having raised features in accordance with one embodiment of the invention.

FIG. 6 is an exploded schematic cross-sectional view illustrating an embodiment of an FED 100 with the faceplate 110 and the baseplate 150 after a raised feature or coupling element 180 has been formed on each bond pad 154 of the baseplate 150. It will be appreciated that the raised features 180 may be formed on the connector pads 124 of the faceplate 110 instead of the bond pads 154. Once the faceplate 110 and baseplate 150 are properly oriented with respect to each other, they are pressed together while energy is imparted to the raised features 180 to bond the raised features 180 to the connector pads 124 and the bond pads 154. The raised features 180 may be composed of different materials and they may be formed using several different methods.

Figure 7:
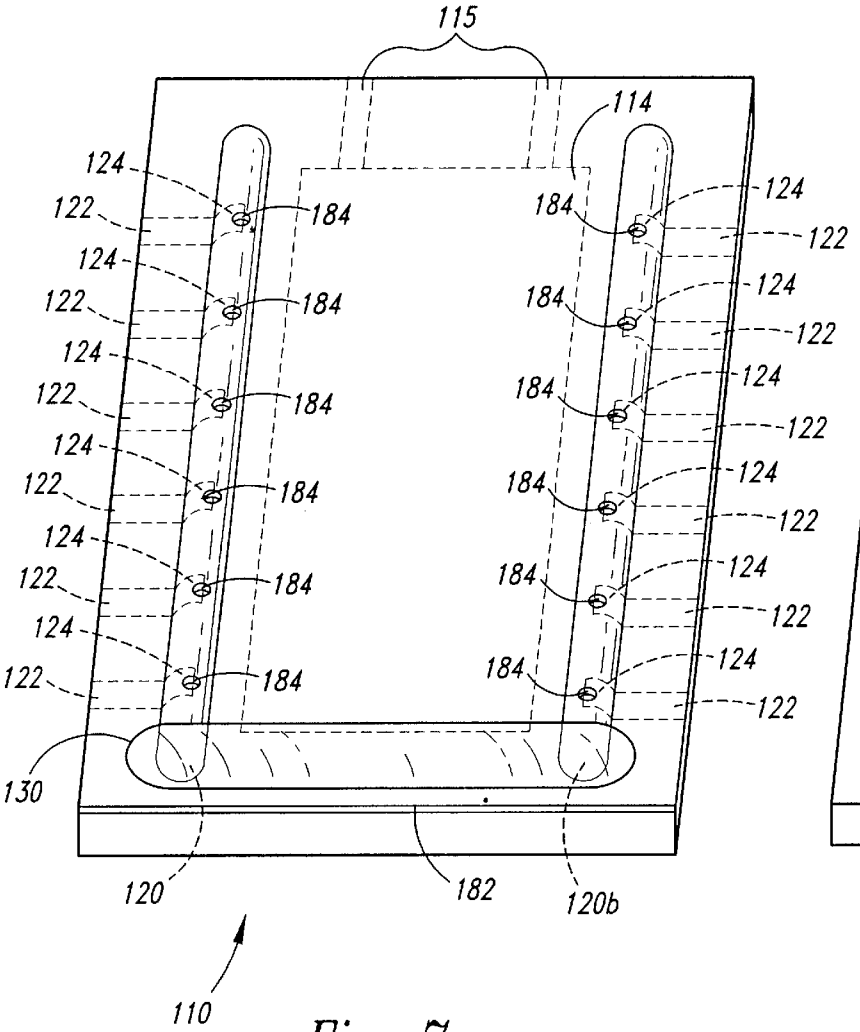
FIG. 7 is a schematic isometric view of a screen printing device used at a subsequent stage of an embodiment of the method of the invention to form raised features on the faceplate of FIG. 4.

FIG. 7, for example, is a schematic isometric view illustrating one embodiment of a method for forming a plurality of coupling elements or raised features composed of a thick film conductive material at bonding locations on the faceplate 110. In this embodiment, a screen 182 with a plurality of applicators or holes 184 is positioned over or on the faceplate 110. The holes 184 are configured in the same pattern as the connector pads 124, and each hole 184 defines a path through which a pad of thick film conductive bonding material may be deposited onto a corresponding connector pad 124. The holes 184 may also be configured to correspond to the pattern of bond pads 154 on the baseplate 150 (FIG. 5) because this embodiment of the method is equally applicable to faceplates and baseplates. After the holes 184 are aligned with corresponding connector pads 124, a discrete mass of the thick film conductive material defining a pad (not shown) is then deposited or otherwise placed substantially simultaneously through each hole 184 onto each connector pad 124.

For example, the pads of conductive material may be deposited onto the connector pads 124 by disposing a large volume of the thick film conductive material 130 onto the screen 182, wiping the large volume of thick film conductive material 130 across the screen 182 to fill the holes 184 with a portion of the conductive material, and then removing the screen 182 from the faceplate 110. The portions of the thick film conductive material that fill the holes 184 will remain on top of the connector pads 124 after the screen 182 is removed from the faceplate 110 to form the pads of conductive material on the connector pads 124. After the thick film conductive material is deposited onto each bonding location, the thick film conductive material may be heated or fired in an oven to cure or reflow the material. Once the thick film conductive material is cured, it forms a raised feature 180 (FIG. 6) on each connector pad 124 for attaching the baseplate 150 (FIG. 5) to the faceplate 110.

The thick film conductive material is preferably a flowable paste composed of finely divided conductive particles and a flowable binding compound that has sufficient viscosity. Suitable conductive particles may be composed of gold, aluminum, nickel, solder, and other finely divided conductive materials.

Compared to conventional methods for forming raised features at bonding locations on a plate of a field emission display, certain embodiments of the invention are expected to reduce the time for forming such raised features at all of the bonding locations. Unlike conventional methods in which the raised features are formed individually, certain embodiments of the present invention form all of the raised features on a baseplate or a faceplate substantially simultaneously. Accordingly, some embodiments of the invention may form a large number of raised features in the same amount of time that it takes conventional methods to form only a few raised features.

Figure 8:
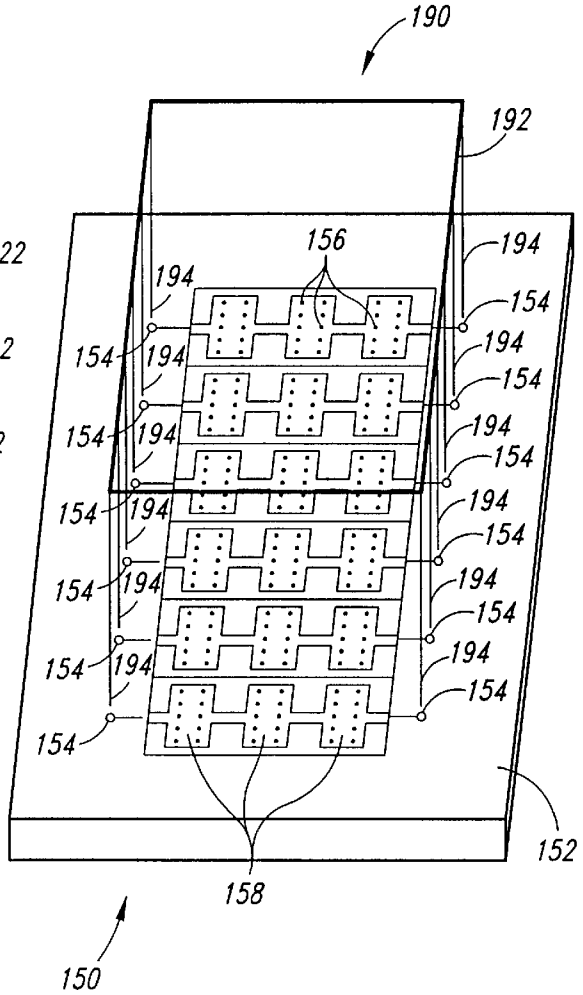
FIG. 8 is a schematic isometric view of a microneedle assembly used at a subsequent stage of an embodiment of the method of the invention to form raised features on the baseplate of FIG. 5.

FIG. 8 is a schematic isometric view depicting another embodiment of a method for forming raised features composed of a thick film conductive material at bonding locations on the baseplate 150 shown in FIG. 5. In this embodiment, a microneedle assembly 190 with a frame 192 and a plurality of microneedle applicators 194 attached to the frame 192 places pads of conductive paste on the bond pads 154 of the baseplate 150. It will be appreciated, however, that the microneedle assembly 190 may also place pads of conductive paste on the connector pads 124 of the faceplate 110 shown in FIG. 4. The microneedle applications 194 are accordingly arranged in a pattern corresponding to either the pattern of bond pad 154 on the baseplate 150 or the pattern of the connectors 124 on the faceplate 110. The microneedles 194 may be connected to a common reservoir (not shown) containing the thick film conductive material, and the common reservoir may be pressurized to dispense the conductive material from each microneedle 194 substantially simultaneously. The pads (not shown) of the thick film conductive material may accordingly be deposited onto the bond pads 154 by dispensing a small, discrete volume of thick film conductive material from each microneedle 194 onto each respective bond pad 154. The thick film conductive material is then cured as discussed above with respect to FIG. 7. One microneedle assembly 190 suitable for the present invention is the Micropen manufactured by Micro Pen Corporation.

In another embodiment, a single microneedle 194 may be sequentially aligned with each bond pad 154 to sequentially deposit a pad of conductive paste on each bond pad 154. This embodiment is particularly applicable for forming raised features on a small number of baseplates or faceplates because a large number of microneedles do not need to be configured in the pattern of the bonding locations. Conversely, it is generally more desirable to form the conductive pads substantially simultaneously as described in FIG. 8 when the raised features are being formed on a large number of like baseplates or faceplates.

Figure 9:
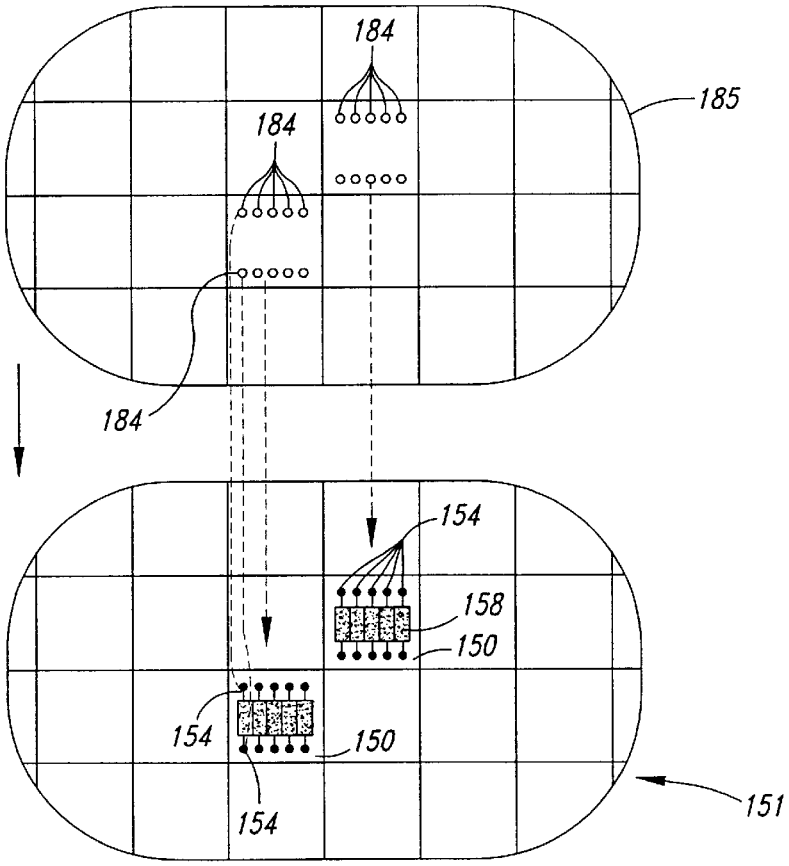
FIG. 9 is a schematic isometric view of another screen printing apparatus used in accordance with another embodiment of a method of the invention.

FIG. 9 illustrates another embodiment of a method for forming raised features on the bonding locations of a plurality of baseplate subassemblies 150 still attached to one another on a wafer 151. Each baseplate 150 has emitters 156, emitter sets 158, and bond pads 154 as discussed above with respect to FIG. 5. Before the baseplates 150 are separated from one another by cutting the wafer 151, a large screen 185 having a number of applicator holes 184 is used to screen print the thick film conductive material onto the bond pads 154 substantially simultaneously. In this embodiment of the invention, the applicator holes 184 are configured on the large screen 185 to correspond to the pattern of bond pads 154 across the entire surface of the wafer 151. The applicator holes 184 are then aligned with each bond pad 154 by moving either the large screen 185 or the wafer 151 with respect to one another until each bond pad 154 is positioned with respect to one of the applicator holes 184. After the bond pads 154 and respective applicator holes 184 are aligned with each other, the thick film conductive material is deposited onto each bond pad 154 substantially simultaneously as discussed above with respect to FIG. 7. This embodiment of the method is expected to provide a very fast, cost efficient process for forming raised features on the bonding locations. As such, many faceplate and baseplate subassemblies may be prepared for flip-chip bonding in less time than it takes to prepare a few bonding locations on a single subassembly using conventional methods. Accordingly, some embodiments of this method may significantly reduce the time and cost for preparing faceplates and/or baseplates for flip-chip bonding.

Figure 10:
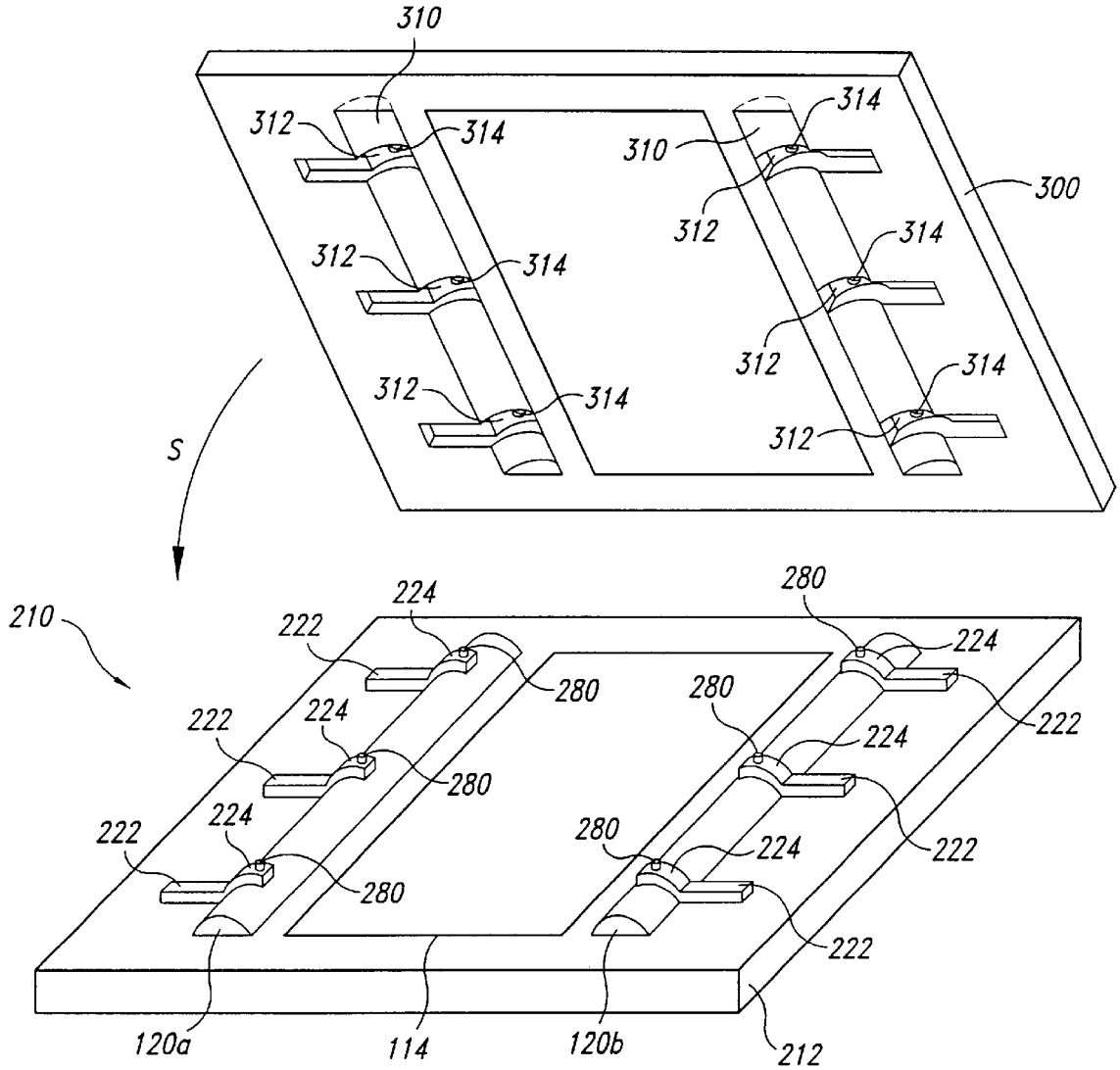
FIG. 10 is an exploded schematic isometric view of a die and a faceplate with raised features formed using the die in accordance with another embodiment of the invention.

FIG. 10 is a schematic isometric view of another embodiment of a faceplate 210 upon which a plurality of raised features 280 have been formed by stamping the faceplate 210 with a die 300. In this embodiment, the faceplate 210 has a plurality of leads 222 with thick connector pads 224 extending over the apex of the spacers 120*a* and 120*b*. The connector pads 224 are spaced apart along the spacers 120*a* and 120*b* to correspond to the pattern of bond pads on the baseplate (not shown). The leads 222 may be about 12–20 $\mu$m thick, and the connector pads 224 may be approximately 20–50 $\mu$m thick. The die 300 accordingly has trenches or channels 310 to receive the spacers 120*a* and 120*b*, and a plurality of grooves 312 spaced apart from one another along the trenches 310 corresponding to the spacing between the connector pads 224 on the faceplate 210. Each groove 312 has a depth with respect to the trench 310 corresponding to the desired thickness of the connector pads 224, and a hole or a recess 314 projects from each groove 312. The recesses 314 are configured in the desired shape of the raised features 280 formed on the connector pads 224.

In operation, the die 300 moves (arrow S) toward the faceplate 210 to press the grooves 312 against the connector pads 224. When the connector pads 224 are composed of gold or another suitably malleable material, the connector pads 224 conform to the shape of the grooves 312 and the recesses 314 to form the raised features 280 on top of the connector pads 224. The raised features 280 may thus be formed without necessarily depositing additional materials onto the faceplate 210 or baseplate (not shown).

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A method of manufacturing a field emission display, comprising:

constructing a faceplate having a transparent substrate, an anode covering the substrate, a cathodoluminescent film covering the anode, and a plurality of connector pads, the connector pads being spaced apart from one another in a defined pattern;

fabricating a baseplate having an emitter substrate with a plurality of emitters, an extraction grid over the emitter substrate with a plurality of holes aligned with the emitters to expose the emitters, and a plurality of bond pads selectively coupled to the emitters, the bond pads being configured in the defined pattern of the connector pads;

forming a plurality of raised features substantially simultaneously on a plurality of bonding sites defined by one of the connector pads or the bond pads so that a separate raised feature is formed at each bonding site;

positioning the faceplate and the baseplate in a juxtaposed relationship to one another in which the raised features on the bonding sites are aligned with the other of the connector pads or the bond pads; and joining the faceplate and baseplate together to contact the raised features with both the connector pads and the bond pads.

2. The method of claim 1 wherein constructing a faceplate comprises constructing a faceplate having first and second spacers extending along sides of the anode and cathodoluminescent film, the plurality of connector pads being formed on the spacers.

3. The method of claim 1 wherein joining the faceplate and baseplate together comprises pressing the faceplate and baseplate together.

4. The method of claim 1 wherein forming a plurality of raised features comprises:

aligning a plurality of applicators with the bonding sites;

depositing a discrete volume of a thick film conductive material through each applicator to produce a conductive pad of thick conductive film paste at each bonding site; and curing the conductive pads to form a conductive raised feature at each bonding site.

5. The method of claim 4, further comprising providing a screen with a plurality of holes configured in a pattern corresponding to a pattern of the bonding sites, wherein each hole defines an applicator, and wherein depositing a discrete volume of a thick film conductive material through each applicator comprises wiping a large mass of the thick film conductive material across the screen to press each discrete mass of conductive paste through a corresponding hole in the screen, and then removing the screen from the plate.

6. The method of claim 1 wherein forming the plurality of raised features comprises:

laying a plurality of gold traces on the faceplate in a desired configuration in which each trace has a first section defining a lead and a second section defining one of the connector pads;

aligning a plurality of recesses of a die with corresponding second sections of the gold traces, each recess being configured in a desired shape and size of the raised features; and pressing the die against the gold traces to drive a portion of the second sections into the corresponding recesses to form a raised feature on each connector pad.

7. A field emission display, comprising:

a faceplate having a transparent substrate, an anode covering the substrate, a cathodoluminescent film covering the anode, and a plurality of connector pads, the connector pads being spaced apart from one another in a defined pattern;

a baseplate having an emitter substrate with a plurality of emitters and a plurality of bond pads selectively coupled to the emitters, the bond pads being configured in the defined pattern of the connector pads, and the baseplate plate and faceplate being juxtaposed to one another to align each bond pad with a corresponding connector pad; and a plurality of coupling elements composed of a thick film conductive paste positioned between the bond pads and the connector pads, wherein a single coupling element contacts a bond pad and a corresponding connector pad.

8. The method of claim 7 wherein the faceplate includes first and second spacers extending along sides of the anode and cathodoluminescent film, the plurality of connector pads being formed on the spacers.

9. The field emission display of claim 7 wherein the coupling elements are cured pads of a gold conductive paste.

10. The field emission display of claim 9 wherein the cured pads are formed through a microneedle.

11. The field emission display of claim 7 wherein the baseplate further comprises an extraction grid over the emitter substrate with a plurality of holes aligned with the emitters to expose the emitters.

12. A method of forming a conductive raised feature on a plate of a field emission display, comprising;

forming a connector pad from a conductive material at a bonding location on the plate;

aligning a recess in a die with the connector pad; and driving a portion of the connector pad into the recess to form a raised feature at the bonding location.

13. The method of claim 12 wherein forming a connector pad comprises laying a trace of gold on the plate to have a first section defining a lead and a second section defining the connector pad.

14. The method of claim 12 wherein forming a connector pad comprises laying a trace of gold on a faceplate to have a first section defining a lead and a second section on a spacer of the faceplate defining the connector pad.

15. The method of claim 14 wherein laying the trace of gold comprises depositing the gold in the first section with a first thickness and depositing the gold in the second section with a second thickness greater than the first thickness.

16. The method of claim 12 wherein the die has a plurality of recesses configured in a pattern corresponding to a desired pattern of raised features for the plate, and wherein:

forming a connector pad comprises fabricating a plurality of connector pads by laying a plurality of gold traces on the plate in a desired configuration in which each trace has a first section defining a lead and a second section defining an individual connector pad positioned at a desired bonding location;

aligning the recesses in the die comprises positioning the die over the plate so that the recesses are juxtaposed to corresponding connector pads; and driving a portion of the connector pad into the recess comprises forcing a portion of each connector pad into a corresponding recess to form a raised feature on each connector pad.

17. A method of manufacturing a field emission display, comprising:

constructing a faceplate having a transparent substrate, an anode covering the substrate, a cathodoluminescent film covering the anode, first and second spacers extending along sides of the anode and cathodoluminescent film, and a plurality of connector pads on the spacers, the connector pads being spaced apart from one another along the spacers in a defined pattern;

fabricating a baseplate having an emitter substrate with a plurality of emitters, an extraction grid over the emitter substrate with a plurality of holes aligned with the emitters to expose the emitters, and a plurality of bond pads selectively coupled to the emitters, the bond pads being configured in the defined pattern of the connector pads;

forming a plurality of raised features substantially simultaneously on a plurality of bonding sites defined by one of the connector pads or the bond pads so that a separate raised feature is formed at each bonding site;

positioning the faceplate and the baseplate in a juxtaposed relationship to one another in which the raised features on the bonding sites are aligned with the other of the connector pads or the bond pads; and pressing the faceplate and baseplate together to contact the raised features with both the connector pads and the bond pads.

18. The method of claim 17 wherein forming the plurality of raised features comprises:

laying a plurality of gold traces on the faceplate in a desired configuration in which each trace has a first section defining a lead and a second section defining one of the connector pads;

aligning a plurality of recesses of a die with corresponding second sections of the gold traces, each recess being configured in a desired shape and size of the raised features; and pressing the die against the gold traces to drive a portion of the second sections into the corresponding recesses to form a raised feature on each connector pad.

19. The method of claim 17 wherein forming a plurality of raised features comprises:

aligning a plurality of applicators with the bonding sites;

depositing a discrete volume of a thick film conductive material through each applicator to produce a conductive pad of thick conductive film paste at each bonding site; and curing the conductive pads to form a conductive raised feature at each bonding site.

20. The method of claim 19, further comprising providing a screen with a plurality of holes configured in a pattern corresponding to a pattern of the bonding sites, wherein each hole defines an applicator, and wherein depositing a discrete volume of a thick film conductive material through each applicator comprises wiping a large mass of the thick film conductive material across the screen to press each discrete mass of conductive paste through a corresponding hole in the screen, and then removing the screen from the plate.

21. The method of claim 19, further comprising providing an assembly of microneedles configured in a pattern corresponding to a pattern of the bonding sites, wherein each microneedle defines an applicator, and wherein depositing a discrete volume of a thick film conductive material through each applicator comprises forcing each discrete mass of the thick film conductive paste through a corresponding microneedle.

22. A field emission display, comprising:

a faceplate having a transparent substrate, an anode covering the substrate, a cathodoluminescent film covering the anode, first and second spacers extending along sides of the anode and cathodoluminescent film, and a plurality of connector pads on the spacers, the connector pads being spaced apart from one another along the spacers in a defined pattern;

a baseplate having an emitter substrate with a plurality of emitters and a plurality of bond pads selectively coupled to the emitters, the bond pads being configured in the defined pattern of the connector pads, and the baseplate plate and faceplate being juxtaposed to one another to align each bond pad with a corresponding connector pad; and a plurality of coupling elements composed of a thick film conductive paste positioned between the bond pads and the connector pads to both wherein a single coupling element contacts a bond pad and a corresponding connector pad.

23. The field emission display of claim 22 wherein the coupling elements are cured pads of a gold conductive paste.

24. The field emission display of claim 23 wherein the cured pads are formed through holes in a screen.

25. The field emission display of claim 23 wherein the cured pads are formed through a microneedle.

26. The field emission display of claim 23 wherein the cured pads are formed through a plurality of microneedles.

27. The field emission display of claim 22 wherein the baseplate further comprises an extraction grid over the emitter substrate with a plurality of holes aligned with the emitters to expose the emitters.

* * * * *

UNITED STATES PATENT AND TRADEMARK OFFICE

CERTIFICATE OF CORRECTION

PATENT NO. : 6,255,769 B1
DATED : July 3, 2001
INVENTOR(S) : David A. Cathey and Charles M. Watkins It is certified that error appears in the above-identified patent and that said Letters Patent is hereby corrected as shown below:

Column 10,
Line 33, please delete "to both".

Signed and Sealed this

Thirtieth Day of July, 2002

*Attest:*

*Attesting Officer*

JAMES E. ROGAN
*Director of the United States Patent and Trademark Office*